United States Patent [19]

Becker

[11] 4,127,988

[45] Dec. 5, 1978

[54] GAS TURBINE INSTALLATION WITH COOLING BY TWO SEPARATE COOLING AIR FLOWS

[75] Inventor: Bernard Becker, Mulheim, Germany

[73] Assignee: Kraftwerk Union Aktiengesellschaft, Mulheim, Germany

[21] Appl. No.: 817,228

[22] Filed: Jul. 20, 1977

[30] Foreign Application Priority Data

Jul. 23, 1976 [DE] Fed. Rep. of Germany ..... 2633291

[51] Int. Cl.[2] ..... F02C 7/18

[52] U.S. Cl. ..... 60/39.66; 415/115; 415/116

[58] Field of Search ..... 60/39.66, 39.07; 415/115, 116

[56] References Cited

U.S. PATENT DOCUMENTS

| | | | |
|---|---|---|---|
| 3,377,803 | 4/1968 | Prachar | 60/39.66 |
| 3,453,825 | 7/1969 | May et al. | 60/39.66 |
| 3,742,706 | 7/1973 | Klompas | 60/39.66 |
| 4,008,977 | 2/1977 | Brown et al. | 60/39.66 |

*Primary Examiner*—Robert E. Garrett
*Attorney, Agent, or Firm*—Herbert L. Lerner

[57] ABSTRACT

Gas turbine installation includes a compressor and a gas turbine and has a rotor including rotary parts of the compressor and the gas turbine, the compressor having an air flow path therethrough external to the rotor. The gas turbine installation further includes a system for cooling the parts of the gas turbine including means defining two different air flow paths within the rotor, one of the cooling air flow paths within the rotor branching from the external air flow path at an intermediate stage of the compressor at which the absolute velocity of the air flow into the rotor is relatively low and extending to an axial region of the rotor, and the other of the cooling air flow paths within the rotor branching from the external air flow path at a location downstream from the compressor in flow direction of the external air flow at which the circumferential velocity of the air flow into the rotor is relatively high and extending into a radially outwardly disposed region of the rotor, both of the cooling air flow paths extending mutually concentrically through a nonpartioned chamber in the rotor to the rotary parts of the gas turbine.

4 Claims, 6 Drawing Figures

GAS TURBINE INSTALLATION WITH COOLING BY TWO SEPARATE COOLING AIR FLOWS

The invention relates to a gas turbine installation with a cooling system for the parts of the turbine including two separate cooling air flow paths, one of which branches off from an intermediate compressor stage and the other of which from a location downstream from or behind the compressor.

Such an installation has become known heretofore from the German Published Non-Prosecuted Application DT-OS 2 261 343. In this known construction, the cooling air flow path branched off from behind or downstream of the compressor cools the high-temperature zone of the turbine and the partial flow path branched off from the intermediate compressor stage cools parts in the middle and rear zone of the turbine. The two cooling air flow paths which are concentric to one another are mutually separated by a partition rotating with the air flows passing through the cooling air flow paths, which, moreover, requires considerable constructive cost.

A further considerable problem in such a cooling air construction as that of the aforementioned German Published Application is the large pressure loss, which is caused by the centrifugal force field produced inside the rotor. To reduce these losses, two approaches are generally taken: The air can be conducted inwardly in radially inwardly directed channels whereby, besides friction losses, the pressure differences in a so-called solid-state vortex must be overcome. However, a relatively costly construction is necessary for conducting or guiding the air. The second approach is to conduct or guide the air inwardly in a free rotational cavity, a potential vortex being developed, the strength of which being reducible by suitably shaping the inlet bores into the rotor.

It is an object of the invention to provide a gas turbine installation wherein, with relatively low constructive cost, highly stressed parts can be cooled by two separate cooling air flows, and wherein the losses of the cooling system can be kept low.

With the foregoing and other objects in view, there is provided, in accordance with the invention, a gas turbine installation with a compressor and a gas turbine and having a rotor including rotary parts of the compressor and the gas turbine, the compressor having an air flow path therethrough external to the rotor, comprising a system for cooling the parts of the gas turbine including means defining two different air flow paths within the rotor, one of the cooling air flow paths within the rotor branching from the external air flow path at an intermediate stage of the compressor at which the absolute velocity of the air flow into the rotor is relatively low and extending to an axial region of the rotor, and the other of the cooling air flow paths within the rotor branching from the external air flow path at a location downstream from the compressor in flow direction of the external air flow at which the circumferential velocity of the air flow into the rotor is relatively high and extending into a radially outwardly disposed region of the rotor, both of the cooling air flow paths extending mutually concentrically through a nonpartioned chamber in the rotor to the rotary parts of the gas turbine.

In accordance with another feature of the invention, there is provided a diffuser secured to a compressor disk of the compressor for guiding air flow in the one cooling air flow path into the rotor and comprising an annular disk formed with substantially cylindrical cooling air bores terminating tangentially to the inner periphery of the annular disk.

In accordance with a further feature of the invention, the diffuser is formed by an outer part of a compressor disk. In accordance with a concomitant feature of the invention, there are provided means defining substantially radially extending bores for guiding air flow in the other of the air flow paths into the rotor.

Although the invention is illustrated and described herein as embodied in gas turbine installation with a cooling system employing two separated cooling air flows, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
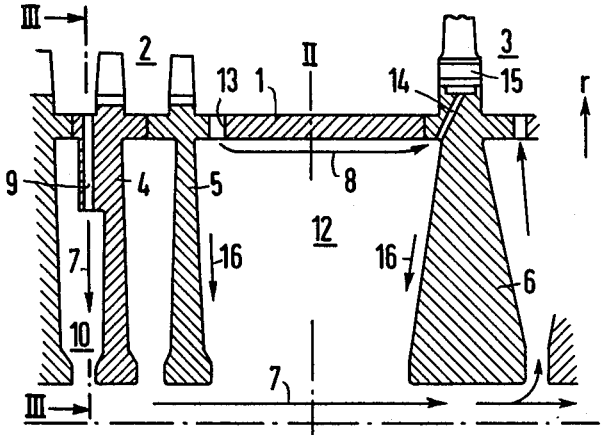
FIG. 1 is a fragmentary longitudinal sectional view of a gas turbine constructed in accordance with the invention, in the vicinity of the rearmost compressor wheels and the foremost turbine wheels thereof and showing the path of the cooling air by means of arrows.

Referring now to the drawing and first, particularly to FIG. 1 thereof, there is shown part of a rotor 1 of a gas turbine set which includes a compressor section 2 as well as a gas turbine section 3, only the last two disks 4 and 5 of the compressor disks as well as the first disk 6 of the gas turbine disks, as viewed in general travel direction of air through the gas turbine set, being illustrated in the interest of keeping the drawing as simple and as clear as possible. Two separate cooling air flows 7 and 8, which will be discussed in greater detail hereinafter, are provided for cooling the gas turbine disks.

Figure 3:
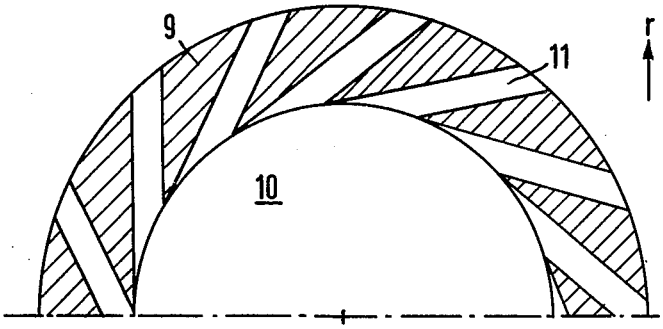
FIG. 3 is a diagrammatic cross-sectional view of FIG. 1 taken along the line III—III in the direction of the arrows and showing a diffuser which is disposed in vicinity of a compressor disk or wheel.

For cooling the rear turbine stages, as viewed in the aforementioned general air travel direction, quantities of air tapped from the middle compressor zone and having low temperature and low pressure are used. These tapped quantities of cooling air are withdrawn through a distributor or diffuser 9 shown in detail in FIG. 3, ahead or upstream of the compressor disk 4.

As noted hereinbefore, the pressure loss is caused, in substance, by a centrifugal-force field produced in the interior of the rotor 1. The pressure gradient in the centrifugal-force field can be described in the case of simple radial equilibrium by the following equation:

$$dp/dr = \sigma\,(c_u^2/r),$$

wherein $p$ = static pressure $\sigma$ = density $r$ = radius $c_u$ = circumferential component of the absolute flow velocity $u$ = circumferential velocity of the walls.

Figure 4:
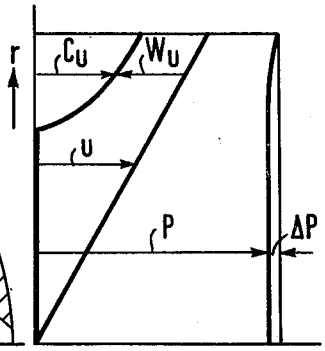
FIG. 4 is a plot diagram similar to that of FIG. 2 and indicating the velocity and pressure distribution along the cross-section line III—III in FIG. 1.
Figure 5:
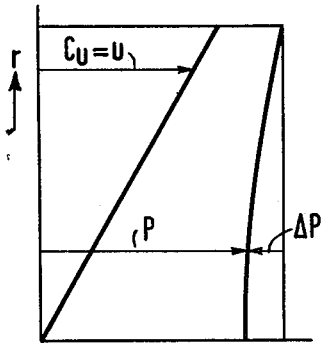
FIG. 5 is a plot diagram corresponding to those of FIGS. 2 and 4 taken along a cross-section line for a solid state vortex.
Figure 6:
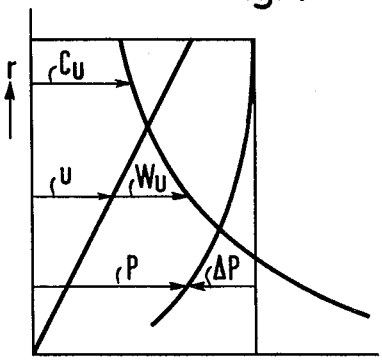
FIG. 6 is a plot diagram similar to that of FIG. 5 taken along a cross-section line for a potential vortex.

From this equation, it is found that especially large pressure losses i.e. changes of pressure, occur for high absolute circumferential velocity, high density, small radius and large changes of radius. According to the invention of the instant application, the air guidance is such that $c_u << u$ in an inner radial region which is as large as possible, and the pressure loss is thereby minimized. For this purpose, the cooling air is conducted from the outside toward the inside into the interior space 10 through a diffuser 9 disposed in the outer radial region, in such a manner that it flows out of the diffuser 9 nearly tangentially. To this end, most simply, cylindrical bores 11 are formed in the diffuser 9 and are provided with such an inclination that they emerge nearly tangentially at the inner periphery of the diffuser 9. Thus, the cooling air has a velocity $w_u$ relative to the rotating system which is approximately of the same magnitude as, but of opposite direction to the circumferential or peripheral velocity u of the walls, as is readily apparent from the diagram shown in FIG. 4. The absolute velocity, which determines the strength of the centrifugal-force field, thereby becomes very small. It then also only negligibly changes its magnitude, due to torque or angular moment principles, in the annular or ring space 10 which is free of any structural members or inserts. The effect of friction, which produces a codirectional torque or angular moment, can be counterbalanced or counteracted by application of a slight opposing torque or angular moment at the inlet to the annular space 10. Because of the quadratic or square-law dependence of the pressure change upon the velocity, the pressure loss $\Delta p$ is nearly zero also in the case of this non-ideal flow which is subjected to friction which is also apparent from the diagram in FIG. 4. In any case, the pressure loss is smaller than for all heretofore known proposals for solving this problem, such as the proposal wherein the cooling air is conducted inwardly in radially directed channels, and flow conditions are attained in a solid state vortex according to the diagram of FIG. 5, and such as the proposal wherein the cooling air is conducted freely through a potential vortex according to the diagram of FIG. 6.

The inflow into the diffuser 9 is advantageously constructed so that the circumferential component corresponds approximately to the torque or angular moment prevailing in the compressor 2. The shock loss is thereby reduced. Also, the required radial component at the diffuser inlet to the channels 11 causes no appreciable loss because of the deflection in tangential direction.

To cool the high-temperature region of the turbine, an additional cooling air flow 8 with high pressure from the compressor outlet is to be selected, as is described hereinafter. Both cooling air flows 7 and 8, however, are to be conducted or guided separately without using additional parts such as partitions or the like and without the occurrence of any appreciable mixing.

As is apparent from FIG. 1, the strongest possible centrifugal-force field is to be formed for this purpose in the space 12, wherein both cooling-air flows 7 and 8 pass through the same space at different pressure levels. This is accomplished by introducing the externally flowing, highly compressed air 8 into the rotor through radial or only slightly inclined bores 13 downstream from the last compressor disk 5 and, accordingly, imparting thereto a high circumferential or peripheral velocity ($c_u \sim \omega \cdot r_a$). Because of the large radius in the vicinity of the outer circumference or periphery of the rotor, the angular moment or torque $c_u \cdot r$ is very high. Since the radius varies only slightly along the provided flow path 8, however, the pressure loss is small.

The cooling air flows out along the inner path 7, on the other hand, with low circumferential velocity ($c_u \sim u_i$), the radius and the circumferential component producing a very weak torque or angular moment. The outer, highly compressed cooling air flow 8 is then fed through suitable channels 14 to the highly stressed zones at the blade foot or base 15 of the first gas turbine disk 6.

Figure 2:
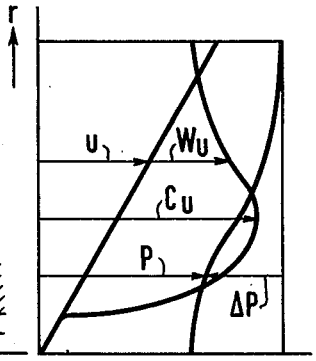
FIG. 2 is a plot diagram indicating the velocity and pressure distribution along the flow cross-section line II—II in FIG. 1.

Because of the considerable pressure difference between the outer flow 8 and the inner flow 7, a predeterminable amount of air will always flow from the outside to the inside, as indicated by the arrows 16. The absolute velocity of the air flow represented by the arrow 16 increases inversely proportionally to the radius, in accordance with the torque or angular moment theroem or principles; thereby, a strong centrifugal-force field is built up, wherein, with the conventional circumferential or peripheral velocities and radii relationships customary in gas turbine construction, the pressure differences required for separation of the main air flows 7 and 8 are generated. The corresponding pressure and flow conditions are apparent from the diagram in FIG. 2 which, for all practical purposes, virtually constitute a superposition of the corresponding pressure and velocity relationships from the diagram of FIG. 6 for the potential vortex and of the lower portion of the diagram in FIG. 4 for the first cooling air flow 7 fed in through the diffuser. Tests have shown that very small quantities of air are sufficient to overcome the frictional moment, so that the transfer or transition of air from the outer to the inner system remains relatively small, and the gain attainable by the two-loop system is retained, in substance, due to reduction of the compressor input power and the improvement of the efficiency of the cooling air. Special construction measures such as pipes, labyrinths, hollow shafts or the like for separating the two cooling air systems from one another and from the flow of hot gas are unnecessary with the construction of the rotor and the cooling air inlets thereof, according to the invention.

There are claimed:

1. Gas turbine installation with a compressor and a gas turbine and having a rotor including rotary parts of the compressor and the gas turbine, the compressor having an air flow path therethrough external to the rotor, comprising a system for cooling the parts of the gas turbine including means defining two different air flow paths within the rotor, one of said cooling air flow paths within the rotor branching from the external air flow path at an intermediate stage of the compressor at which the absolute velocity of the air flow into the rotor is relatively low and extending to an axial region of the rotor, and the other of said cooling air flow paths within the rotor branching from the external air flow path at a location downstream from the compressor in flow direction of the external air flow at which the circumferential velocity of the air flow into the rotor is relatively high and extending into a radially outwardly disposed region of the rotor, both of said cooling air flow paths extending mutually concentrically through a non-partitioned chamber in the rotor to the rotary parts of the gas turbine.

2. Gas turbine installation according to claim 1 including a diffuser secured to a compressor disk of the compressor for guiding air flow in said one cooling air flow path into the rotor and comprising an annular disk formed with substantially cylindrical cooling air bores terminating tangentially to the inner periphery of said annular disk.

3. Gas turbine installation according to claim 2 wherein said diffuser is formed by an outer part of a compressor disk.

4. Gas turbine installation according to claim 1 including means defining substantially radially extending bores for guiding air flow in said other of said air flow paths into the rotor.

* * * * *